United States Patent [19]

Egorov et al.

[11] 4,060,582

[45] Nov. 29, 1977

[54] METHOD OF MANUFACTURING POLYOXYMETHYLENE FILAMENTS

[76] Inventors: Boris Afanasievich Egorov, ulitsa Pavla Tychiny, 12b, kv. 11; Alexandr Sergeevich Grzhimalovsky, ulitsa Karla Libknekhta, 11/1, kv. 15; Alexandr Vladimirovich Judin, Rusanovsky bulvar, 3, kv. 73; Konstantin Evgenievich Fishman, ulitsa Krasnotkatskaya, 17, kv. 47; Ljudmila Dmitrievna Vernaya, ulitsa Yanvarskogo vosstaniya, 24, kv. 98, all of Kiev, U.S.S.R.

[21] Appl. No.: 497,060

[22] Filed: Aug. 13, 1974

[51] Int. Cl.[2] ..... D01D 5/12

[52] U.S. Cl. ..... 264/210 F; 264/176 F; 264/290 R

[58] Field of Search ..... 260/67 FP; 264/210 F, 264/176 F, 290 R

[56] References Cited

U.S. PATENT DOCUMENTS

| | | | |
|---|---|---|---|
| 3,219,623 | 11/1965 | Bernardinelli | 260/67 FP |
| 3,235,531 | 2/1966 | Walker | 260/67 FP |
| 3,347,969 | 10/1967 | Moelter | 264/210 |
| 3,426,754 | 2/1969 | Bierenbaum et al. | 128/156 |

*Primary Examiner*—Jay H. Woo

*Attorney, Agent, or Firm*—Fleit & Jacobson

[57] ABSTRACT

A method of manufacturing polymethylene filaments, wherein polyoxymethylene having the molecular weight from 30,000 to 100,000 and containing stabilizing additives in a quantity from 0.1 to 3.0 per cent of the weight of the polyoxymethylene is subjected to thermal treatment at a temperature from 100° to 150° C. and residual pressure from 1 to 100 mm mercury to attain constant weight. The thus thermally treated polyoxymethylene is melted at a temperature from 170° to 230° C., whereafter the melt is forced through the orifices of an extrusion nozzle. The jets of the melt, leaving the orifices of the extrusion nozzle, are cooled at a temperature from 70° to 169° C. After the cooling the obtained filaments are drawn at a temperature from 120° to 165° C. to a length exceeding from 7 to 14 times the initial length.

The disclosed method offers a simple technology of producing filaments as strong as 100 grams per tex.

To produce low-shrinkage fiber (i.e. with a shrinkage rate from 0 to 5 per cent at 150° C.) the drawn filaments are thermally treated at a temperature exceeding that of the drawing by 2° C. to 50° C., the filaments being maintained under tension. Alternatively, the drawn filaments may be first tensioned and then thermally treated, as indicated hereinabove.

3 Claims, No Drawings

METHOD OF MANUFACTURING POLYOXYMETHYLENE FILAMENTS

A method of manufacturing polymethylene filaments, wherein polyoxymethylene having the molecular weight from 30,000 to 100,000 and containing stabilizing additives in a quantity from 0.1 to 3.0 percent of the weight of the polyoxymethylene is subjected to thermal treatment at a temperature from 100° C to 150° C and residual pressure from 1 to 100 mm mercury to attain constant weight. The thus thermally treated polyoxymethylene is melted at a temperature from 170° C to 230° C., whereafter the melt is forced through the orifices of an extrusion nozzle. The jets of the melt, leaving the orifices of the extrusion nozzle, are cooled at a temperature from 70° C. to 169° C. After the cooling the obtained filaments are drawn at a temperature from 120° C to 165° C. to a length exceeding from 7 to 14 times the initial length.

The disclosed method offers a simple technology of producing filaments as strong as 100 grams per tex.

To produce low-shrinkage fibre (i.e. with a shrinkage rate from 0 to 5 percent at 150° C.) the drawn filaments are thermally treated at a temperature exceeding that of the drawing by 2° to 50° C., the filaments being maintained under tension. Alternatively, the drawn filaments may be first tensioned and then thermally treated, as indicated hereinabove.

The present invention relates to the methods of manufacturing polyoxymethylene filaments, and, more particularly, of high-strength low-shrinkage polyoxymethylene filaments.

These filaments can be widely used in the production of fishing nets and trawls, of filtering cloth, of engineering rubber articles, cord, etc., since they offer a whole series of valuable properties. Thus, among their properties is the one of being hydrophobic or water-repellent, which means that their strength is unaffected by moisture; they are proof to the action of alkali, as well as of numerous organic solvents at a temperature up to 100° C.; they are likewise proof to the action of sea water and are biologically stable. Polyoxymethylene filaments also offer high tensile strength, resistance to rubbing, fatigue strength and elasticity.

Furthermore, polyoxymethylene filaments and yarn can be widely used in the production of numerous textile articles, e.g. in the form of texturized or bulk yarn.

There already exists a number of methods of manufacturing polyoxymethylene filaments from melted polyoxymethylene by moulding a filament with subsequent drawing.

The high viscosity of the melt and the high crystallization rate of polyoxymethylene are reflected in the specific features of its processing into filaments. The relatively low temperature viscosity factor and the relatively low thermal stability of the melt would not permit to reduce the viscosity of the melt any considerably by increasing the temperature. Particular difficulties are encountered at processing of polyoxymethylene with a high molecular weight, which is the one generally used for manufacturing polyoxymethylene filaments with high physical and mechanical properties, such as elasticity, fatigue strength, etc. It is this high viscosity of the melt of polyoxymethylene, particularly, of polyoxymethylene with a high molecular weight, which dooms the rate of extrusion of the filaments to be substantially lower than that of extrusion of filaments of other materials, usually attained in the art of making man-made fibre.

There is known a method of manufacturing polyoxymethylene filaments, wherein, in order to step up the extruding speed (and, consequently, the winding speed) there is effected "cooling" of the jets of the melt, leaving the orifices of the extrusion nozzle, at a temperature from 170° to 240° C. (see Japan Pat. No. 3486, Cl. 42D22). From the described examples of this method it can be seen that raising the temperature of the air in the vicinity of the extrusion nozzle from normal to 190° C. enables to step up the extruding speed from 160 m/min to 670 m/min. However, the ratio of subsequent drawing of the filament thus obtained at a temperature of 150° C. does not exceed 7:1, and, consequently, the strength of this filament is but 67.5 grams per tex with e longation at rupture about 20 percent.

There is known another method of manufacturing polyoxymethylene filaments from melted stabilized homo- and co-polymers of formaldehyde or else of its cyclic trimer - trioxane - with cyclic esters, e.g. ethylene oxide, 1,3 dioxolane, etc. (see British Pat. No. 995,848, Cl. D 01 f, D 06 m, C 08 g). Stabilizing additives are included in a quantity, for example, of 0.1 to 3.0 percent of the weight of the polymer. To reduce the viscosity of the melt there is sometimes added into the stabilized polymer a certain quantity of a plastifier. To mould polyoxymethylene filaments, the said homo- or copolymers are subjected to melting at a temperature from 170° C. to 230° C. and at the same temperature the melted polymer is forced through the orifices of an extrusion nozzle. The jets of the melt, leaving the orifice, are cooled in the ambient air. After the cooling, the moulded filament is subjected to drawing. By drawing the moulded filament at a rate of 10.2 m/min and temperature from 120° to 150° C., e.g. 134° C., the draft, for example, being 9.05 : 1, there is obtained a filament with the strength not in excess of 54.9 grams per tex. In order to step up the strength of the filament, it is subjected to a repeated drawing at a rate of 10.5 m/min at a temperature from 150° to 160° C., the draft being from 105 : 1 to 2:1. As a result, the strength is increased to 89.1 grams per tex.

The use of plastifiers in certain cases involves the necessity of resorting to additional labour-consuming operations of removing the plastifier. On the other hand, the presence of the plastifier in a final filament considerably affects its physical and mechanical properties.

To obtain filaments of a sufficiently high strength by the last-described method, the moulded filament is drawn not in a single stage, but in two stages, which also complicates the technology. Besides, this drawing is effected at a relatively low speed, which lowers the productivity of the equipment.

Furthermore, the cooling of the jets leaving the nozzle in the ambient air would not permit to mould the filaments at high speeds, which becomes particularly pronounced, when polyoxymethylene of a high molecular weight is processed.

It is an object of the present invention to develop a method of manufacturing polyoxymethylene filaments, which should provide for obtaining polyoxymethylene filaments with high physical and mechanical properties.

It is another object of the present invention to simplify the technology of the manufacturing process.

With these and other objects in view, the present invention resides in a method of manufacturing polyoxymethylene filaments, including melting at a temperature from 170° to 230° C, a mass of polyoxymethylene having the molecular weight from 30,000 to 100,000 and containing stabilizing additives in a quantity of 0.1 to 3.0 percent of the weight of the polyoxymethylene mass, forcing the melt thus obtained through the orifices of an extrusion nozzle, cooling the jets of the melt, leaving the extrusion nozzle and drawing the thus moulded filaments at a temperature from 120° to 165° C. to a length exceeding the initial length from 7 to 14 times. In accordance with the invention, the said mass of polyoxymethylene, containing the said additives, is subjected prior to the melting to a thermal treatment at a temperature from 100° to 150° C. and residual pressure from 1 to 100 mm mercury to a constant weight, and the jets of the melt, leaving the orifices of the extrusion nozzle, are cooled at a temperature from 70° to 169° C.

For the filament-forming polyoxymethylene there are used either homo- or co-polymers of formaldehyde or else of its cyclic trimer - trioxane - with cyclic esters of a general formula, for example

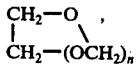

where

"$n$" is an integer within a range from 0 to 2. The weight content of the second co-monomer in the co-polymer may vary within a range from 0.5 to 10 percent, depending on the destination of the filaments to be manufactured.

The molecular weight ($M_w$) of the polyoxymethylene used may vary from 30,000 to 100,000 and is calculated from the formula: $[\tau]=K.M_w^{\alpha}$ where $[\tau]$ is the characteristic viscosity of solution of polyoxymethylene in dimethylformamide, measured at 150° C. ± 0.5° C on Ostwald-Pinkevich viscosimeter; K equals $4.4 \cdot 10^{-4}$ and $\alpha$ equals 0.66.

It is not advisable to use polyoxymethylene with a molecular weight below 30,000, since the strength of filaments produced from such a polymer is insufficient. On the other hand, when polyoxymethylene with a molecular weight in excess of 100,000 is used, there are encountered certain technological difficulties on account of the high viscosity of the melt.

An increased content of the second co-monomer in the copolymer leads to a lower melting point of the co-polymer, and, consequently, to a reduced thermal strength of the filament.

To step up the thermal stability of polyoxymethylene, there are introduced thereinto stabilizing additives in a quantity from 0.1 to 3.0 percent of the weight of the mass of polyoxymethylene. For the stabilizers can be used, for instance, a system of two components including an antioxidant and a acceptor of formaldehyde. Among the antioxidants are such substances as bisphenols, e.g. 2,2'-methylene bis (4-methyl-6-tertiary butyl-phenol); 4,4'-butyledene bis-(6-tertiary butyl-4-methyl-phenol), while among the acceptors are polyamides, polyurethanes, compositions containing tertiary amines and final amide groups, for example, dicyandiamide (cyanguanidine).

The properties of the filament are to a great extent dependent on the initial raw materials and the technological conditions of their manufacture.

Stabilized polyoxymethylene may contain up to 0.2 percent by weight of equilibrium moisture (water). The presence of the moisture (water) in the polymer adversely affects the moulding and drawing operations and the quality of the filaments. An increased content of water leads to formation of bubbles of steam in the jets of the melt, leaving the orifices of the extrusion nozzle, which might result in breakage of the jets in the moulding operation, or else in breakage of the filament during subsequent drawing.

Under the herein disclosed conditions of thermal treatment of the initial mass of polyoxymethylene to a constant weight, i.e. at a temperature from 100° to 150° C. and residual pressure from 1 to 100 mm mercury, it has been quite unexpectedly found that the loss of the weight by the polymer substantially exceeds the content therein of the equilibrium water. It has been also found that the strength of the filament produced from the polymer subjected to this thermal treatment is enhanced. The loss of the weight by the polymer at this thermal treatment may be explained by the fact that in addition to water there are removed from the mass of polyoxymethylene several other compositions: on the one hand, there is formaldehyde mechanically added to the polyoxymethylene during granulation of the latter; on the other hand, there is formaldehyde breaking from the unstable portion of the macromolecules of polyoxymethylene. Besides, it is not altogether improbable that under the above conditions there are partially removed the stabilizing additives which had been introduced earlier.

The presence of volatile compositions in the mass of polyoxymethylene likewise adversely affects the processing properties of the polymer, as it is the case with water. The presence of volatile compositions in the mass of polyoxymethylene, on the one hand, influences the permissible range of melting temperatures. With a high content of volatile substances there might appear in the melt an amount of bubbles which is the greater, the higher is this melting temperature. Consequently, with a reduced content of volatile substances in the mass of polyoxymethylene, which is attained by the abovedescribed preliminary thermal treatment, it is fairly permissible to raise the melting temperature. On the other hand, the smaller the content of volatile substances in the melt of polyoxymethylene, the smaller is the degree of their evolution from the jets of the melt, leaving the orifices of the extrusion nozzle, and, consequently, the smaller is the probability of jet breakage.

The Table hereinbelow contains data on the amount of volatile substances removed from the stabilized copolymer of trioxane and 1,3 dioxolane (the latter contained in a quantity of 4 percent by weight), as well as on the amount of water left in the co-polymer, depending on the thermal treatment conditions.

| Temp. °C | Residual content of water in specimen, % by weight | Amount of volatile substances removed from specimen, % by weight | Residual content of water in specimen % by weight | Amount of volatile substances removed from specimen % by weight |
|---|---|---|---|---|
| | Thermal treatment in air under normal pressure | | Thermal treatment in vacuum, with residual pressure from 1 to 5 mm mercury | |
| 20 | 0.12 | — | 0.12 | — |
| 100 | 0.04 | 0.16 | traces | 0.26 |
| 140 | 0.02 | 0.42 | d.t.o. | 0.62 |

-continued

| Temp. °C | Residual content of water in specimen, % by weight | Amount of volatile substances removed from specimen, % by weight | Residual content of water in specimen % by weight | Amount of volatile substances removed from specimen % by weight |
|---|---|---|---|---|
| | Thermal treatment in air under normal pressure | | Thermal treatment in vacuum, with residual pressure from 1 to 5 mm mercury | |
| 155 | traces | 0.55 | d.t.o. | 0.70 |

It can be seen from the above data that the amount of removed volatile substances grows with the increase of the temperature of the treatment and with the reduction of the pressure, whereas the water content is practically unaffected by these conditions. The water content was determined by a method based on reduction of iodine in the presence of water by sulphur dioxide, known as the Fischer method (see "Control over production of chemical fibre", "Khimiya" Publishers, Moscow, 1967, p. 293). The amount of the removed volatile substances was determined as the difference between the weight of the specimen prior to and after the thermal treatment.

Moulding of the filaments is effected by melting the stabilized polyoxymethylene which had been subjected to the thermal treatment, forcing the melt through the orifices of an extrusion nozzle and cooling down the jets of the melt, leaving the orifices of the nozzle. The melting temperature can be in the range from 170° to 230° C., depending on the nature of the polyoxymethylene being processed, on its molecular weight and the time of its existence in the melted state, determined by the capacity of the equipment used. The cooling down of the jets of the melt in the vicinity of the nozzle is effected at a temperature from 70° to 169° C. Under the herein disclosed "mild" cooling conditions, the general molecular orientation of the composition is affected and, consequently, the drawing ability of the moulded filaments is stepped up (the draft can be increased), as compared with the drawing ability of filaments moulded at a lower cooling temperature, e.g. at 20° C. The phenomenon of reduction of general molecular orientation at processing of polyoxymethylene of a high molecular weight, as high as 50,000 to 100,000, is particularly pronounced. Filaments moulded at higher cooling temperatures and subjected to greater draft offer better physical and mechanical properties.

The cooling media can be air, an inert gas, e.g. nitrogen, steam.

After the cooling the moulded filament is drawn at a temperature from 120° to 165° C. to a length exceeding the initial length 7 to 14 times. At temperatures below 120° C. it is not possible to draw polyoxymethylene to a degree providing for production of filaments with adequately high strength. This fact is related to the high degree of crystallinity of polyoxymethylene, as well as to the large size of the abovemolecular structure. To break up this structure for drawing purposes, it is essential that the filament should be heated up to a temperature not below 120° C. As the temperature is raised above 145° – 150° C., there takes place maximally complete breaking up of the initial above-molecular structure, which simplifies the task of its re-arrangement and re-orientation, and, consequently, the attainable value of draft is sharply increased. Under these conditions it becomes possible to draw the moulded filament to a length exceeding the initial length from 9 to 14 times even by single-stage drawing, which provides for high physical and mechanical properties of the filament.

As the drawn polyoxymethylene filaments are worked into various articles and during operation of these articles under the action of elevated temperatures, there might be developed within these filaments considerable internal stresses, as high as 10 kg/mm$^2$. Thus, if the filament during its thermal treatment is not tensioned, these internal stresses might lead to shrinkage of the filament, and at the same time there might take place reduction of the tensile strength and increasing of the value of elongation at rupture.

In order to reduce shrinkage of the produced filaments at subsequent thermal treatment, as well as to maintain the strength of the filaments after such subsequent thermal treatment it is advisable that the drawn polyoxymethylene filaments should be subjected to a thermal treatment at a temperature 2° to 50° C. above the temperature at which the filaments were drawn, with the filaments being in a tensioned state. It is possible first to tension the drawn filaments and then to subject them to the said thermal treatment.

As it has been already stated hereinabove, in the process of thermal treatment of a filament manufactured from thermally pre-treated stabilized polyoxymethylene under the abovespecified conditioned no reduction of the original strength of the filament is encountered. However, in the process of similar thermal treatment of a filament manufactured from the same stabilized polyoxymethylene pre-treated under different conditions, e.g. in open air at a temperature of 140° C., the filament has been found to lose its strength after the abovespecified thermal treatment thereof.

The herein disclosed method is simple technologically. It does not require any specific equipment. The method provides for processing into filaments polyoxymethylene of a high molecular weight without the use of plastifiers (i.e. substances reducing the viscosity of the melt of polyoxymethylene) the addition of which brings about the necessity of carrying out an additional operation connected with removal of these plastifiers from the filament. Furthermore, a filament produced from thermally pre-treated polyoxymethylene and moulded under the raid cooling conditions is characterized by low general molecular orientation and a minimal content of gas-like impurities. Therefore, it can be drawn under a given temperature duty even in a single stage, with high draft and high drawing speeds (as high as 100 m/min) which further simplifies the technology and increases the productivity of the equipment.

The herein disclosed method provides for manufacturing polyoxymethylene filaments having high physical and mechanical properties. The tensile strength of the filaments is within a range from 70 to 100 grams per tex, with elongation at rupture from 9 to 12 percent, the initial modulus being from 1200 to 1800 kilograms per square millimeter. The filaments offer an increased thermal stability and stability to the action of acids, high fatigue strength and rubbing resistance. Moreover, the herein disclosed method provides for reducing considerably the degree of shrinkage of a drawn filament, due to the filament having been subjected to tensioning and thermal treatment.

The method of manufacturing polyoxymethylene filaments is carried out, as follows.

An initial mass of polyoxymethylene, e.g. in the form of granules, containing stabilizing additives, is thermally pre-treated on a standard equipment, e.g. in vacuum drum-type dryers at a temperature from 100° to 150° C and residual pressure from 1 to 100 mm mercury to constant weight. The said thermal treatment may be effected in an inert gas atmosphere, e.g. in a nitrogen atmosphere. In this case the temperature of thermal pre-treatment of polyoxymethylene may be stepped up to 160° to 165° C., and the operation may be carried out under atmospheric pressure.

Thereafter the thermally pre-treated polyoxymethylene is melted, preferably, in an extrusion machine. The melting is performed at a temperature from 170° to 230° C., depending on the chemical nature and molecular weight of the polyoxymethylene used. The melting operation may be carried out either in air or in an inert gas atmosphere, e.g. in a nitrogen atmosphere. The temperature of melting depends on the nature of the polyoxymethylene used, on the atmosphere in which the melting is performed, on the design on the equipment and may vary from 0.1 to 60 minutes.

The thus obtained polyoxymethylene melt is fed by a metering pump to an extrusion nozzle having either one or several orifices. Prior to being supplied to the nozzle, wherever necessary, the melt may be filtered through metal filtering screens, quartz sand or any other suitable filtering means.

The jets of the melt, leaving the orifices of the extrusion nozzle, are cooled, e.g. in an atmosphere of air heated to 70° - 169° C. This may be performed in a closed heated shaft, or else by directing a steam of heated gas, as it is being generally done at the manufacturing of a majority of known synthetic filaments produced by moulding from a polymer melt.

The filament leaving the cooling zone has applied thereon a lubricant, water or any other substance, depending on the destination of the filament.

Then the filament is either wound into a package or else this stage is by-passed, and the filament is fed directly into a drawing machine. In other words, the herein disclosed method may be performed both in an intermittent and continuous mode.

Drawing or drafting of the filament is effected in a single stage at a temperature from 120° to 165° C. to a 7:1 to 14:1 draft. The drawing operation is performed by a commonly known system including a feed roller and a drafting one, the circumferential speed of the drafting roller being higher than that of the feeding one. Heating of the filament is effected intermediate of the rollers. The filament can be heated by contact heaters of the "iron" type, or else by passing through a heated tube (with either hot air or radiation heating); alternatively, the filament may pass through a heated liquid. The drawn filament, depending on its destination, may be either twisted or not twisted. The twisting may be performd by any suitable known twisting mechanism, e.g. of the ring twisting kind. It is also possible to cut the drawn filament into stable fibre of a required length.

To obtain low-shrinkage polyoxymethylene filament, the drawn filament is tensioned and thermally treated at a temperature 2° to 50° C. above the drawing temperature. The thermal treatment may be performed in a continuous "drawing-cum-thermal treatment" process. In this case thermal treatment of the filament may be effected by various existing systems providing for tensioning the filament and heating it to required parameters, e.g. a system including a pair of rollers intermediate of which there is ensured a required tension and a heater is provided. In a case of an intermittent process any suitable technique may be used, e.g. thermal treatment of the filament wound at a required tension on a rigid bobbin. The thermal treatment of the filament may be performed in various atmospheres (gaseous or liquid) wherein no chemical destruction of polyoxymethylene takes place, or else in air. The time and parameters of the thermal treatment of the filament are defined by the requirements as to the value of permissible shrinkage of final filaments.

For the present invention to be better understood, there are described hereinbelow several examples.

EXAMPLE 1

Granulated co-polymer of trioxane and 1,3-dioxolane (the weight content of the latter being 4 percent) with additives: 2,2'-methylene bis (4-methyl-6-tretbutylphenol) in a quantity of 0.5 percent by weight as the antioxidant and formaldehydedicyandiamide in a quantity of 0.5 percent by weight as the acceptor, with characteristic viscosity in dimethylformamide equalling 0.56 is thermally treated at 100° C. and residual pressure of 5 mm mercury, melted in an extrusion machine in an air atmosphere at 190° C., and the melt is forced by a metering pump through an extrusion nozzle with a single orifice 1.2 mm in diameter. The rate of feed of the melt is 5 gr/min. The jet of the melt is cooled in a 0.5 m long tube. The temperature of the air cooling the jet of the melt is 90° C. The filament moulding rate is 250 m/min.

The moulded filament is drawn to a 10:1 draft at a speed of 125 m/min over a 250 mm long "iron" at 150° C. The obtained filament has 72 grams per tex tensile strength and elongation at rupture equalling 11.5%. The shrinkage of the filament is 18%, with 80% of the initial strength remaining after the shrinkage.

After the drawing operation the filament is thermally treated in air under a tension of 2 kilograms per square millimeter at 155° C. for 30 minutes. After this treatment the shrinkage value is 4%, with 95% of the initial strength remaining after the shrinkage.

EXAMPLE 2

Polyoxymethylene filaments are moulded and drawn, as described above in Example 1, with a difference that the initial mass of polyoxymethylene is thermally treated at 130° C. and residual pressure of 10 mm mercury; the co-polymer is melted at 200° C., and the jet of the melt is cooled in air at a temperature of 70° C.

The filament obtained features 75 gr/tex tensile strength and 11.1% elongation at rupture. The shrinkage rate of this filament is 17%, with 82% of the initial strength remaining after the shrinkage. After the drawing operation the filament is thermally treated in a nitrogen atmosphere at 161° C. under 6 kg/mm$^2$ tension for 20 minutes. After this treatment the shrinkage rate of the filament is 1%, with 96% of the initial strength remaining after the shrinkage.

EXAMPLE 3

Polyoxymethylene filaments are moulded and drawn, as described above in Example 1, with a difference that a co-polymer of formaldehyde and 1,3-dioxolane is used, having characteristic viscosity in dimethylformamide equalling 0.65; the co-polymer is thermally treated at 150° C. and 1 mm mercury residual pressure; the co-polymer is melted at 185° C., and the jet of the melt is cooled in air at 140° C. in a 0.4 m long tube. The moulded filament is drawn to a 12:1 draft at a speed of 75 m/min over a 400 mm long "irong".

The filament obtained has 86 gr/tex tensile strength and 10% elongation at rupture. The shrinkage rate of this filament is 15%, with 87% of the initial strength remaining after the shrinkage.

After the drawing the filament is thermally treated at 170° C. in a nitrogen atmosphere under 10 kg/mm² tension for 5 minutes. Following this treatment the shrinkage is 0.5% with 95% of the initial strength remaining after the shrinkage.

EXAMPLE 4

A polyoxymethylene filament is moulded as described above in Example 3, a difference being in that the co-polymer is thermally treated at 140° C. and residual pressure of 95 mm mercury; the co-polymer is melted at 180° C; the jet of the melt is cooled in air at 120° C.

The moulded filament is drawn to a 13.6:1 draft at a speed of 25 m/min over a 1000 mm long "iron" at 158° C.

The filament obtained is characterized by 98 gr/tex tensile strength and 9% elongation at rupture. The shrinkage rate of the filament is 11%, with 90% of the initial strength remaining after the shrinkage.

After the drawing the filament is thermally treated at 150° C under 0.2 kg/mm² tension for 150 minutes. Following the treatment, the shrinkage of the filament is 3%, with 94% of the initial strength remaining.

EXAMPLE 5

A polyoxymethylene filament is moulded and drawn, as described above in Example 1, with a difference that there is used a copolymer of trioxane and a cyclic ester, i.e. ethylene oxide (the weight content of the latter being 3 percent), having characteristic viscosity in dimethylformamide equalling 0.50; the co-polymer is thermally treated at 130° C. and residual pressure equalling 50 mm mercury; the co-polymer is melted at 170° C., and the melt is forced through an extrusion nozzle having 24 orifices 0.40 mm in diameter. The rate of feed of the melt is 20 grams per minute. The jets of the melt are cooled in a 0.7m long tube with air at 100° C. The filament moulding rate is 450 m/min.

The filament obtained is characterized by 76 gr/tex tensile strength and 14% elongation at rupture. The shrinkage of this filament is 20%, with 75% of the initial strength remaining after the shrinkage.

After the drawing the filament is thermally treated in a nitrogen atmosphere at 152° C. under 4 kg/mm² tension for 240 minutes.

Following this treatment the shrinkage is 5%, with 92% of the initial strength remaining.

EXAMPLE 6

Polyoxymethylene filaments are moulded and drawn, as described above in Example 5, with a difference that the temperature of the air cooling the jets of the melt is 70° C.

The moulded filament is drawn to a 7 : 1 draft at a 10 m/min speed over a 700 mm long "iron" at 120° C.

The filament obtained has 62 gr/tex tensile strength, with 16% elongation at rupture. The shrinkage rate of this filament is 25%, with 67% of the initial strength remaining after the shrinkage.

After the drawing the filament is thermally treated in a nitrogen atmosphere at 150° C. under 8 kg/mm² tension.

Following this treatment the shrinkage rate at 150° C. is 10%, with 85% of the initial strength remaining.

EXAMPLE 7

A co-polymer of formaldehyde and 1,3-dioxolane (the weight content of the latter being 5%) in a powder form is mixed with stabilizing additives, viz. 2,2'-methylene bis (4 methyl-6-tertbutylphenol) in a quantity of 2.5% by weight as the antioxidant and formaldehyde-dicyanamide in a quantity of 0.5% by weight as the acceptor; the co-polymer is thermally treated, as described above in Example 5 and melted at 170° C. The co-polymer used has characteristic viscosity of 0.42.

The filament is moulded, as described hereinabove in Example 6, and drawn to a 8:1 draft in a contactless 800 mm long heater in an atmosphere of air heated to 130° C. at a speed of 50 m/min.

The filament obtained is characterized by 59 gr/tex tensile strength and 20% elongation at rupture.

EXAMPLE 8

A granulated homo-polymer of formaldehyde, containing 0.5% by weight co-polymer based on hexamethylenediamine, adipinic acid and caprolactam and 0.5% by weight dicyanamide, having characteristic viscosity in dimethylformamide equalling 0.86, is thermally treated at 110° C. and 0.5 mm mercury pressure. Then the polymer is melted in a nitrogen atmosphere at 210° C., and the melt thus obtained is forced through an extrusion nozzle with 12 orifices 0.8 mm in diameter, the rate of feed of the melt being 20 grams a minute. The jets of the melt are cooled with nitrogen heated to 165° C. The filament moulding speed is 500 m/min.

The moulded filament is drawn to a 8:1 draft at a rate of 15 m/min over a 700 mm long "iron" at 161° C.

The filament obtained has 71 gr/tex tensile strength and elongation at rupture equalling 12%.

EXAMPLE 9

A polyoxymethylene filament is moulded, as described above in Example 1, with a difference that the polyoxymethylene is melted in a nitrogen atmosphere at 225° C., and the melt thus obtained is forced through an extrusion nozzle having 80 orifices 0.5 mm in diameter, the rate of feed of the melt being 150 gr/min. The temperature of the air cooling the jets of the melt is 80° C. The filament moulding speed is 300 m/min.

The moulded filament is drawn to a 9:1 draft over a 500 mm long "iron" at 150° C.

The filament obtained in characterized by 75 gr/tex tensile strength and 13% elongation at rupture. The shrinkage of this filament is 17%, with 82% of the initial strength remaining after the shrinkage.

After the drawing the filament is thermally treated in air at 157° C. under 8 kg/mm² tension for 40 minutes.

Following this treatment the shrinkage rate of the filament is 4%, with 92% of the initial strength remaining.

In the above examples the tensile strength was determined on a pendulum-type rupturing machine, with filament elongation rate being 500 mm/min and clamping length being 250 mm.

The shrinkage rate of the filament is determined from the ratio:

shrinkage rate equals $l_1 - l_2/l_1 . 100\%$, where $l_1$ is the initial length of the specimen, equalling 250 mm;

$l_2$ is the length of the specimen after the filament has been heated slack to 150° C. in air for 0.5 hours.

The strength of the filament, remaining after the shrinkage, is determined from the ratio:

remaining strength of the filament equals $P_2/P_1 . 100\%$, where $P_1$ is the strength of the initial tensioned filament, in grams per tex;

$P_2$ is the strength of the tensioned filament after the shrinkage, also in grams per tex.

What we claim is:

1. A method of manufacturing a polyoxymethylene filament, comprising thermally treating polyoxymethylene having a molecular weight of from 30,000 to 100,000 and containing stabilizing additives including an antioxidant and an acceptor of formaldehyde in a quantity from 0.1 to 3.0% of the weight of said polyoxymethylene at a temperature of from 100° to 150° C and a residual pressure of from 1 to 100 mm. Hg to constant weight, melting said thermally treated polyoxymethylene at a temperature of from 170° to 230° C, forcing the melt through the orifices of an extrusion nozzle, cooling the jets of said melt leaving the orifices of the extrusion nozzle to a temperature of from 70° to 169° C in a cooling medium selected from the group consisting of air, an inert gas and steam, and drawing the moulded filament obtained after said cooling at a temperature of from 120° to 165° C to a length exceeding the initial length by about 7 to 14 times to obtain a polyoxymethylene filament having a tensile strength of from 70 to 100 grams per tex, an elongation at rupture of from 9% to 12%, and an initial modulus of from 1200 to 1800 kilograms per square millimeter.

2. A method of manufacturing a polyoxymethylene filament comprising thermally treating polyoxymethylene having a molecular weight of from 30,000 to 100,000 and containing stabilizing additives comprising an antioxidant and an acceptor of formaldehyde in a quantity of from 0.1 to 3.0% of the weight of said polyoxymethylene at a temperature of from 100° to 150° C and at a residual pressure of from 1 to 100 mm. Hg to constant weight, melting said thermally treated polyoxymethylene at a temperature of from 170° to 230° C, forcing the melt through the orifices of an extrusion nozzle, cooling the jets of said melt leaving the orifices of the extrusion nozzle to a temperature of from 70° to 169° C in a cooling medium selected from the group consisting of air, an inert gas and steam, drawing the moulded filament obtained after said cooling at a temperature of from 120° to 165° C to a length exceeding the initial length by about from 7 to 14 times to obtain a polyoxymethylene filament having a tensile strength of from 70 to 100 grams per tex, an elongation at rupture of about from 9% to 12%, and an initial modulus of about from 1200 to 1800 kilograms per square millimeter, and thermally treating the drawn filament, while maintaining it under tension, at a temperature of from 2° to 50° C above the temperature at which the filament was drawn to produce a polyoxymethylene filament having a shrinkage rate of from 0 to 5% at 150° C.

3. The method of claim 2 wherein the jets of said melt are cooled by directing a stream of heated gas past said jets.

* * * * *